US005140723A

United States Patent [19]

Genzel

[11] Patent Number: 5,140,723

[45] Date of Patent: Aug. 25, 1992

[54] WEARABLE PEN HOLDER

[76] Inventor: Charles C. J. Genzel, 108 Geymer Dr., Mahopac, N.Y. 10541

[21] Appl. No.: 606,065

[22] Filed: Oct. 30, 1990

[51] Int. Cl.[5] ..... B43K 25/00

[52] U.S. Cl. ..... 24/10 R; 24/3 A; 24/11 R

[58] Field of Search ..... 24/10 R, 11 R, 11 CC, 24/11 PP, 12, 3 R, 3 S, 3 L, 3 A, 3 M, 616, 71 J; 248/205.3

[56] References Cited

U.S. PATENT DOCUMENTS

| | | | |
|---|---|---|---|
| 301,133 | 7/1884 | Lilley et al. | 24/12 |
| 597,295 | 1/1898 | Pihl | 24/12 |
| 853,577 | 5/1907 | Connell | 24/3 A |
| 1,032,401 | 7/1912 | Hager | 24/10 R |
| 1,274,312 | 7/1918 | Nicoll | 24/3 A |
| 1,704,075 | 3/1929 | Brown | 24/10 R |
| 3,178,784 | 4/1965 | Krauthamer | 24/10 R |
| 3,387,341 | 6/1968 | Mates et al. | 24/10 R |
| 3,550,824 | 12/1970 | Bohanski | 24/3 A |
| 3,627,182 | 12/1971 | Calkins | 248/205.3 |
| 4,674,298 | 6/1987 | Wimmershoff-Caplan | 24/10 R |

FOREIGN PATENT DOCUMENTS

| | | | |
|---|---|---|---|
| 13151 | of 1891 | United Kingdom | 24/11 CC |
| 217059 | 6/1924 | United Kingdom | 24/12 |

*Primary Examiner*—Victor N. Sakran

[57] ABSTRACT

An article of manufacture for holding pens or pencils which includes a plate having attached thereto adjustable clips for holding the pen or pencil. The plate is designed to be worn as a pin on an article of clothing, to be attached to a necklace or chain, to be part of an article of jewelry such as a bracelet, or to be attached to an object that is carried, such as a book, notebook, book bag, etc. While the plate is generally planar, it can be non-planar, such as a bowed member for use with a bracelet.

7 Claims, 1 Drawing Sheet

WEARABLE PEN HOLDER

DESCRIPTION

1. Field of the Invention

This invention relates to an article of manufacture for holding a pen, pencil, or other writing instrument, and more particularly to a holder which can be adaptable to be worn or carried by another item such as a book or notebook.

2. Background Art

Nowadays people, and particularly students, seem to lose or not have with them pens, pencils, etc. If pens or pencils are carried, they are frequently carried in pockets where they are prone to break. This is particularly true for boys who most often do not carry or break pens and pencils. Female students will generally carry pens or pencils in pocketbooks or purses, but these often get broken and more frequently are lost. Of course, students also just do not like carrying pens or pencils and refuse to do so, relying on someone else or the teacher to provide them when necessary.

While pens generally include as integral portions thereof for securing the pen to a shirt pocket, a notebook, etc., suitable holders are not found in the art. In particular, the holders which are provided represent just an additional item to be carried by a student, which makes the problem of carrying a pen or pencil even more objectionable to the student. Bearing in mind the aversion of students to carrying pens and pencils, it is a primary object of this invention to provide a holder for a writing instrument which can be attractive and ornamental while being wearable, as for example a piece of jewelry.

It is another object of this invention to provide a holder for a writing instrument, or instruments, which can be worn as part of a necklace, a bracelet, or a pin while being attractive, decorative, and useful in holding a pen or pencil.

It is another object of this invention to provide a decorative holder for a pen or pencil which can be directly attached to an item, such a book or notebook, which students are apt to carry.

It is another object of this invention to provide a holder for a pen or pencil which is designed in a manner to encourage students or others to carry a pen or pencil.

It is another object of this invention to provide an improved pen and/or pencil holder that is easy to use and nonobtrusive when in use.

BRIEF SUMMARY OF THE INVENTION

An improved pen holder in accordance with this invention includes a plate-like member having at least one set of expandable clips which are adapted to enclose a pen or pencil, holding the pen or pencil securely until removed by the user. The plate can include a pin so that it can be worn as a decorative item on clothing or the plate can be secured to an arm bracelet for wearing about the wrist or arm. As an alternative the plate can include an aperture or loop through which a chain can be placed when the holder is to be attached to a necklace.

In another embodiment, the plate is adapted to be attached to, for instance, a book, notebook or bag by means of a velcro strip attached to the back of the plate which can be mated with another velcro strip on the book, notebook or bag.

These plate holders include clips which are preferably of the expandable type and into which the pen or pencil can be inserted to have it held securely even while the pen holder is being worn or attached to a book or notebook etc. Any type of clip arrangement can be used, including those where a simple mechanism is used to open and close the clip allowing the pen or pencil to be held or released from the clip. In a preferred embodiment, an expandable, spring clip is very economical and would work satisfactorily. Multiple sets of clips can be used to secure each pen or pencil, depending upon the weight and dimensions of the writing instrument.

These holders are designed to provide an attractive and easily useable article which, because of its attractiveness and useability, would encourage the carrying of pens or pencils. In particular, the feature of wearability would appeal to many people, and particularly to students.

These and other objects, features, and advantages, will be apparent from the following more particular description of the preferred embodiments.

BRIEF DESCRIPTION OF THE DRAWINGS

FIG. 1C illustrates in phantom lines a pencil and pen held by these pins.

DESCRIPTION OF THE PREFERRED EMBODIMENTS

The pencil or pen holders of this invention generally comprise a plate, which can be of any shape, and at least one clip thereon for holding a pen or pencil. In one form, the plate is of ornamental shape or design and can be used as part of a pin or a decorative item attached to a necklace. In another form, the plate can have a variable shape, such as an oval or loop which is suitable for an arm bracelet. When the plate is generally planar, it is also suitable to be attached to an object, such as a book or notebook. In general, the pen or pencil holders of this invention are designed to be carried, either as an item that can be worn, such as a pin, bracelet, or necklace ornament, or as an attachment to an object that is generally carried, such as a book, notebook, carrying bag, book bag, etc.

Figure 1A:
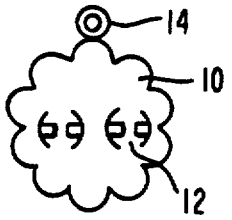
FIGS. 1A, 1B, and 1C are front views of three different pins having expandable clips thereon for holding pens or pencils.
Figure 1B:
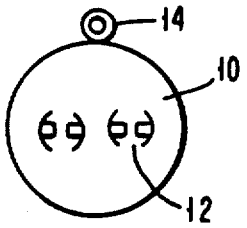

FIGS. 1A-1C and FIG. 2 illustrate the use of generally planar plates having clips thereon for holding a pen or pencil. These planar arrangements are suitable for wearing as a pin or as attachments to a necklace. In FIGS. 1A and 1B, the plate 10 has different shapes, depending upon decorative design. Expandable clips 12 are located on the front of the plates 10 and a loop 14 is provided for hanging from, for example, a necklace. Loop 14 can of course be replaced by an aperture in plate 10.

While expandable clips 12 are most economical and are preferred for holding a pen or pencil, other types of fastening means can be envisioned, such as members which slide into contact with one another in order to lock the pen or pencil in contact with plate 10. Further, there can be any number of clips 12 provided to hold the pen or pencil, depending upon its size, weight and shape.

Plates 10 can be made of any material, but are usually made of metal which can be decorative. However, other types of plates can be used such as ceramic or porcelain plates, wood or plastic plates, and plates fashioned from materials such as nonprecious stones and minerals. Plates 10 can be decorated or engraved as is well known with jewelry or other decorative items. Further, the clips 12, while preferably being of a spring metal in order to accommodate different size pens or pencils, can also be made of other materials, such as various forms of plastic. Depending on the value of the pen to be held, plate 10 can be of a suitable material, such as gold or silver, and can be encrusted with other ornaments, such as jewels.

Figure 1C:
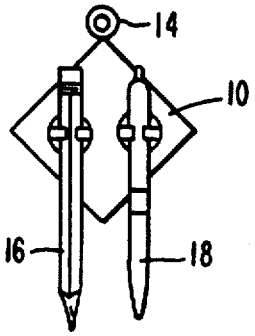

FIG. 1C illustrates a rectangular or square plate 10 having a pencil 16 and a pen 18 shown attached thereto. Loop 14 is provided for attachment to a chain, if desired.

Figure 2:
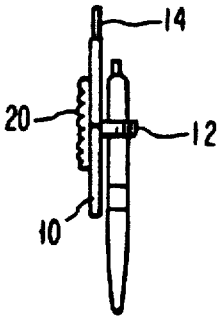
FIG. 2 is a side view of the pin of FIG. 1C illustrating the velcro fastening strip or other means used to attach the pin to an article of clothing, to a book, etc.

FIG. 2 is a side view of the pen or pencil holder of FIG. 1C, and illustrates the fastening means 20 located on the back of plate 10. This fastening means can be, for example, a velcro-type strip that is used to mate with another velcro strip on an article or on clothing, or a fastening pin which is used to pierce an article of clothing or an object for securing the plate 10 thereon. The expandable clips 12 hold the pen or pencil in either a vertical or horizontal plane depending upon the article to which the plate 10 is attached.

Figure 3:
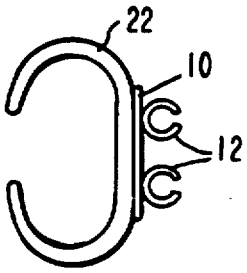
FIG. 3 is a schematic view of an expandable arm bracelet having expandable clips thereon for holding a pen or pencil.

FIG. 3 illustrates another form of the pen or pencil holder of this invention, where the plate 10 is a portion of a generally oval, expandable member 22 which can function as an arm bracelet. The expandable clips 12 are located on the front of plate 10 as in the previous embodiments. Expandable member 22 can be made of many different types of material, such as metals, polymers, wood, etc. While an expandable member 22 may be preferable for a bracelet, the feature of expandability is not required.

Figure 4:
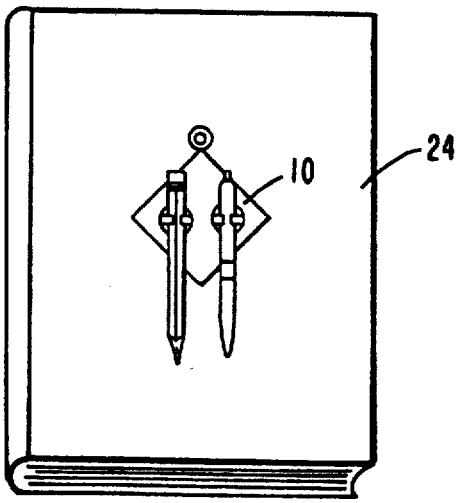
FIG. 4 is a schematic view of a book or notebook having held thereon a plate including expandable clips for securing a pen or pencil.

FIG. 4 illustrates the attachment of the holder of FIG. 1C on a book or notebook 24. Here, the plate 10 has a fastening means 20 on its back (as shown in FIG. 2) which is readily attachable to the book or notebook 24. A suitable fastening means is a velcro-type strip having mating portions located on the back of plate 10 and on the surface of book 24.

In the practice of this invention, it will be readily apparent that many types of materials can be used for the plate 10 and for other portions of the holder. For example, the loop member 22 of FIG. 3 can also be formed of a material such as leather, to which the plate 10 is attached. Further, it apparent that pens or pencils of any shape, size, and weight can be accommodated by choosing a suitable plate and clip arrangement 12. While the pen or pencil holders can be made in very elaborate form and of expensive materials, it is also possible to make very inexpensive holders that can be disposed of after limited periods of use. An example would be very inexpensive holders which are designed to be in accordance with fads of interest to people, especially younger students.

While the invention has been described with respect to several embodiments thereof, it will be apparent to those of skill in the art that numerous variations can be made therein without departing from the spirit and scope of the present invention. For example, other types of holders suitable for wearing or being carried by an object can be envisioned.

I claim:

1. An article of manufacture comprising, in combination:

a decorative rigid plate having a first surface with ornamental features thereon, said plate having holding means for holding to said first surface a removable clip means, removable fastening means located on a second surface of said plate for fastening said plate to a fabric or object, a loop means integral with said rigid plate having a flexible chain secured to said loop to be worn by a person, removable clip means for holding a pen or pencil, said removable clip means enabling the attachment of said clip means to said plate or the removal of said clip means therefrom, wherein said rigid plate has VELCRO-means attached to said first surface and said removable clip means has mating VELCRO-means attached thereto for securing said removable clip means to said rigid plate.

2. The article of claim 1, where said plate is attached to an armband, said armband being capable of being placed around a wearer's wrist or arm.

3. The article of claim 1, where said plate is comprised of a metal.

4. The article of claim 1, where said plate is fabricated of a material selected from the group consisting of plastic, ceramic, wood, or other generally hard materials.

5. The article of claim 1, where said expandable clips are comprised of loop-shaped elements consisting of spring material adaptable to be displaced to surround a pen or pencil inserted therein.

6. The article of claim 1, where said plate includes a fastening pin located on a surface of said plate remote from said expandable clips.

7. The article of claim 1, where said plate is substantially planar.

* * * * *